US008753481B2

(12) United States Patent
Blum et al.

(10) Patent No.: US 8,753,481 B2
(45) Date of Patent: Jun. 17, 2014

(54) POWDER COMPOSITION AND USE THEREOF FOR PAPER PRODUCTION

(75) Inventors: Rainer Blum, Mannheim (DE); Gabriel Skupin, Speyer (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/489,815

(22) Filed: Jun. 6, 2012

(65) Prior Publication Data

US 2012/0312490 A1 Dec. 13, 2012

Related U.S. Application Data

(60) Provisional application No. 61/495,385, filed on Jun. 10, 2011.

(51) Int. Cl.

| | |
|---|---|
| ***D21H 17/53*** | (2006.01) |
| ***D21H 17/69*** | (2006.01) |
| ***D21H 19/62*** | (2006.01) |
| ***D21H 23/04*** | (2006.01) |
| ***D21H 23/22*** | (2006.01) |

(52) U.S. Cl.
USPC ..... 162/168.7; 162/158; 162/168.1; 162/181.1; 162/185; 428/407

(58) Field of Classification Search
USPC ..... 162/158, 164.7, 168.1, 168.7, 162/181.1–181.8, 185; 427/372.2, 402, 427/385.5; 428/357, 402, 403, 407; 524/1, 524/80, 401, 425; 527/317.1, 318.2, 332, 527/318.42; 528/271, 300, 302, 308, 354
See application file for complete search history.

(56) References Cited

U.S. PATENT DOCUMENTS

| | | | | |
|---|---|---|---|---|
| 4,789,727 | A | 12/1988 | Sun | |
| 5,397,641 | A * | 3/1995 | Moens et al. | 428/357 |
| 6,018,004 | A | 1/2000 | Warzelhan et al. | |
| 6,114,042 | A | 9/2000 | Warzelhan et al. | |
| 6,201,034 | B1 | 3/2001 | Warzelhan et al. | |
| 6,303,677 | B1 | 10/2001 | Warzelhan et al. | |
| 6,368,725 | B1 * | 4/2002 | Graf et al. | 428/482 |
| 6,409,815 | B1 | 6/2002 | Hennemann et al. | |
| 6,710,135 | B2 * | 3/2004 | Tan et al. | 525/411 |
| 7,304,172 | B2 | 12/2007 | Coates et al. | |
| 8,003,731 | B2 * | 8/2011 | Seeliger et al. | 525/166 |
| 8,222,320 | B2 * | 7/2012 | Scheer et al. | 523/210 |
| 2006/0275597 | A1 | 12/2006 | Thiele | |
| 2007/0181038 | A1 | 8/2007 | Sabesan et al. | |
| 2007/0259992 | A1 | 11/2007 | Tamura et al. | |
| 2007/0266898 | A1 | 11/2007 | Gane et al. | |
| 2008/0319115 | A1 | 12/2008 | Munchow | |
| 2009/0220880 | A1 | 9/2009 | Moffat et al. | |
| 2009/0234042 | A1 * | 9/2009 | Luinstra | 523/105 |
| 2011/0003931 | A1 | 1/2011 | Wilczek et al. | |
| 2012/0045515 | A1 | 2/2012 | Liu et al. | |
| 2012/0045622 | A1 | 2/2012 | Blum et al. | |

FOREIGN PATENT DOCUMENTS

| | | | |
|---|---|---|---|
| DE | 2 214 410 | | 10/1973 |
| DE | 25 16 097 | A1 | 11/1975 |
| DE | 24 45 813 | A1 | 4/1976 |
| DE | 195 11 012 | A1 | 10/1995 |
| DE | 196 29 525 | A1 | 1/1998 |
| DE | 196 29 526 | A1 | 1/1998 |
| DE | 102 09 448 | A1 | 9/2003 |
| EP | 0 407 889 | A1 | 1/1991 |
| EP | 0 784 449 | | 7/1997 |
| EP | 0 792 309 | | 9/1997 |
| EP | 1 264 860 | A1 | 12/2002 |
| EP | 1 656 423 | | 5/2006 |
| EP | 1 838 784 | A1 | 10/2007 |
| EP | 2 098 574 | A2 | 9/2009 |
| GB | 1 505 641 | | 3/1978 |
| WO | WO 92/09654 | A2 | 6/1992 |
| WO | WO 92/14881 | A1 | 9/1992 |
| WO | WO 96/03923 | A1 | 2/1996 |
| WO | WO 96/15173 | A1 | 5/1996 |
| WO | WO 96/15176 | A1 | 5/1996 |
| WO | WO 96/21689 | A2 | 7/1996 |
| WO | WO 96/21692 | A1 | 7/1996 |
| WO | WO 96/25446 | A1 | 8/1996 |
| WO | WO 96/25448 | A1 | 8/1996 |
| WO | WO 98/12242 | A1 | 3/1998 |
| WO | WO 2005/017034 | A1 | 2/2005 |
| WO | WO 2005/063886 | A1 | 7/2005 |
| WO | WO 2006/057353 | A1 | 6/2006 |
| WO | WO 2006/057354 | A1 | 6/2006 |
| WO | WO 2006/074815 | A1 | 7/2006 |
| WO | WO 2006/097353 | A1 | 9/2006 |
| WO | WO 2006/097354 | A1 | 9/2006 |
| WO | WO 2006/128814 | A1 | 12/2006 |
| WO | WO 2007/027711 | A1 | 3/2007 |
| WO | WO 2007/051766 | A1 | 5/2007 |
| WO | WO 2007/125039 | A1 | 11/2007 |
| WO | WO 2010/034710 | A1 | 4/2010 |
| WO | WO 2010/034711 | A1 | 4/2010 |
| WO | WO 2010/034712 | A1 | 4/2010 |
| WO | WO 2010/090596 | A1 | 8/2010 |
| WO | WO 2011/054694 | A1 | 5/2011 |
| WO | WO 2012/025470 | A1 | 3/2012 |
| WO | WO 2012/143323 | A1 | 10/2012 |
| WO | WO 2012/168398 | A1 | 12/2012 |

OTHER PUBLICATIONS

International Search Report and Written Opinion issued Nov. 23, 2012 in PCT/EP2012/060847 filed Jun. 8, 2012 (with English Translation of Categories of Cited Documents).
U.S. Appl. No. 13/503,988, filed Apr. 25, 2012, Yamamoto, et al.
U.S. Appl. No. 14/112,350, filed Oct. 17, 2013, Siegenthaler, et al.

* cited by examiner

*Primary Examiner* — Dennis Cordray
(74) *Attorney, Agent, or Firm* — Oblon, Spivak, McClelland, Maier & Neustadt, L.L.P.

(57) ABSTRACT

The present invention relates to powder compositions whose particles comprise at least one inorganic pigment, wherein at least one biodegradable polyester polymer and/or polyalkylene carbonate polymer is arranged on the pigment surface, a process for producing these powder compositions and use thereof in the production of paper, card and board.

14 Claims, No Drawings

POWDER COMPOSITION AND USE THEREOF FOR PAPER PRODUCTION

The present invention relates to powder compositions whose particles comprise at least one inorganic pigment, on the surface of which at least one biodegradable polyester polymer and/or polyalkylene carbonate polymer is arranged, a process for producing these powder compositions and use thereof in the production of paper, card and board.

There have been various developments in recent years to raise the filler content of papers. Filled papers make it possible to reduce the fibrous fraction and hence lead to reduced production costs. They further have the advantage of being easier to dry, which makes papermaking more economical.

However, increasing the filler content of paper also leads to changed paper properties such as reduced strengths. Therefore, there have been various developments to modify filler material.

These developments mostly involve adding a polymer solution or dispersion to an aqueous slurry of filler material. Ultimately, the modified filler relies on purely physical interactions. The particles of filler material which are obtained by the modification are usually in the form of mixtures.

WO 92/14881 discloses treating an aqueous dispersion of filler material with a combination of water-soluble cationic and anionic strength enhancers for paper, such as polyethyleneimine, polymers of N-vinylformamide and copolymers formed from acrylamide and acrylic acid.

DE-A 25 16 097 discloses mixing aqueous suspensions of inorganic particles having a positive zeta potential with an anionic latex of a resin by choosing the use quantities such that the coated particles obtained have a zeta potential of essentially 0.

DE-A 102 09 448 discloses aqueous suspensions of filler material which are obtained by treating aqueous suspensions of filler material with at least one binder for paper coating compositions by stirring or by application of shearing forces.

WO2006/128814 and also US 2007/0266898 teach polymer-pigment hybrids for papermaking, which are obtained by grinding an aqueous suspension of inorganic pigment in the presence of a binder preferably a styrene-acrylate dispersion.

EP 792309 teaches biodegradable polymers and EP 792309 again teaches crosslinked biodegradable polymers.

Paper-based products coated one or more times with biodegradable polymer (mixtures) are known from WO 2010/034712.

PCT/EP2010/066079 teaches a process for sizing paper using biodegradable polymers as polymeric sizing agent. The biodegradable polymers in question are useful both as engine size and as surface size.

It is an object of the present invention to provide a process for production of paper, card and board having a high filler content whereby paper-based products having improved strength and/or printability are obtained with unchanged or improved paper machine efficiency despite the filler content.

We have found that this object is achieved by a powder composition whose particles comprise at least one inorganic pigment, wherein at least one biodegradable polyester polymer and/or polyalkylene carbonate polymer is arranged on the pigment surface. The invention further provides a process for producing this powder composition and for its use in the production of paper, card and board and also a process for production of paper, card and board using these powder compositions.

The "biodegradable" feature shall for the purposes of the present invention be considered satisfied for any one material or composition of matter when this material or composition of matter has a DIN EN 13432 chapter A.2 percentage degree of biodegradation equal to at least 90% of a suitable reference substance (e.g., microcrystalline cellulose).

The general effect of biodegradability is that the polymers and polymer mixtures (also referred to hereinbelow as polymer (mixtures) for short) decompose within an appropriate and verifiable interval. Degradation may be effected enzymatically, hydrolytically, oxidatively and/or through action of electromagnetic radiation, for example UV radiation, and may be predominantly due to the action of microorganisms such as bacteria, yeasts, fungi and algae. Biodegradability can be quantified for example by polymer (mixtures) being mixed with compost and stored for a certain time. According to DIN EN 13432, for example, $CO_2$-free air is flowed through ripened compost during composting and this treated compost subjected to a defined temperature program.

Biodegradability here is defined via the ratio of the net $CO_2$ released by the sample (after deduction of the $CO_2$ released by the compost without sample) to the maximum amount of $CO_2$ releasable via the sample (reckoned from the carbon content of the sample), as a percentage degree of biodegradation. Biodegradable polymer (mixtures) typically show clear signs of degradation, such as fungal growth, cracking and holing, after just a few days of composting.

Other methods of determining biodegradability are described for example in ASTM D 5338 and ASTM D 6400-4.

Biodegradable polymers are already known to a person skilled in the art and are disclosed inter alia in Ullmann's Encyclopedia of Industrial Chemistry (online version 2009), Polymers, Biodegradable, Wiley-VCH Verlag GmbH & Co. KG, Weinheim, 2009, pages 131.

More particularly, biodegradable polyester polymers for the purposes of the present invention shall subsume biodegradable aliphatic-aromatic polyesters as described in WO 2010/034712.

Biodegradable polyester polymers are preferably aliphatic polyesters or aliphatic-aromatic (partly aromatic) polyesters based on aliphatic and aromatic dicarboxylic acids and aliphatic dihydroxy compounds.

The pigment/polymer arrangement comprises not only pigments with polymeric envelopment but also pigment particles with partial polymeric envelopment. Agglomerates of fewer than 1000 pigment particles with partial or complete polymeric envelopment are also comprised. In pigment particles with polymeric fractions and agglomerates with pigment and polymeric fractions, the ratio of polymer mass to pigment mass can be in the range from 0.001 or less to 10 or more. The range from 0.01 to 1 is preferable.

The pigment surface preferably has arranged on it at least one polymer selected from polyalkylene carbonates and aliphatic or aliphatic-aromatic (partly aromatic) polyesters based on aliphatic and aromatic dicarboxylic acids and aliphatic dihydroxy compounds. These polymers can be present singly or in their mixtures.

Preferably, the biodegradable polyester polymer and/or polyalkylene carbonate polymer is water-insoluble.

In principle, all polyesters based on aliphatic and aromatic dicarboxylic acids and aliphatic dihydroxy compounds, so-called partly aromatic polyesters or aliphatic polyesters formed from aliphatic dicarboxylic acids and aliphatic diols or from aliphatic hydroxy carboxylic acids come into consideration for producing the biodegradable polyester mixtures. These polyesters are all biodegradable to DIN EN 13432. It will be appreciated that mixtures of two or more such polyesters are also suitable.

A preferable embodiment utilizes at least one aliphatic-aromatic polyester polymer.

Aliphatic-aromatic polyesters are polyesters based on aliphatic and aromatic dicarboxylic acids and aliphatic dihydroxy compounds, so-called partly aromatic polyesters. According to the present invention, this shall also subsume polyester derivatives such as polyether esters, polyester amides or polyether ester amides and polyester urethanes (see EP application No. 10171237.0). Suitable partly aromatic polyesters include linear polyesters which are not chain-extended (WO 92/09654). Chain-extended and/or branched partly aromatic polyesters are preferable. The latter are known from WO 96/15173 to 15176, 21689 to 21692, 25446, 25448 or WO 98/12242, which are hereby expressly incorporated herein by reference. Mixtures of different partly aromatic polyesters are similarly suitable. Interesting recent developments are based on renewable raw materials (see WO-A 2006/097353, WO-A 2006/097354 and WO 2010/034710). More particularly, partly aromatic polyesters include products such as Ecoflex® (BASF SE) and Eastar® Bio, Origo-Bi® (Novamont).

Particularly preferable partly aromatic polyesters include polyesters comprising as essential components A) an acid component composed of a1) 30 to 99 mol % of at least one aliphatic dicarboxylic acid or its/their ester-forming derivatives or mixtures thereof, a2) 1 to 70 mol % of at least one aromatic dicarboxylic acid or its/their ester-forming derivative or mixtures thereof, and B) at least one diol component selected from $C_2$- to $C_{12}$-alkanediols and C) at least one component selected from c1) a compound having at least three groups capable of ester formation, c2) a di- or polyisocyanate, c3) a di- or polyepoxide.

Useful aliphatic dicarboxylic acids and their ester-forming derivatives (a1) are generally those having 2 to 18 carbon atoms, preferably 4 to 10 carbon atoms. They can be linear or branched. In principle, however, dicarboxylic acids having a larger number of carbon atoms, for example up to 30 carbon atoms, can also be used.

Examples are oxalic acid, malonic acid, succinic acid, 2-methylsuccinic acid, glutaric add, 2-methylglutaric acid, 3-methylglutaric acid, α-ketoglutaric acid, adipic acid, pimelic acid, azelaic acid, sebacic acid, brassylic acid, fumaric acid, 2,2-dimethylglutaric acid, suberic acid, diglycolic acid, oxaloacetic acid, glutamic acid, aspartic acid, itaconic acid and maleic acid. The dicarboxylic acids or their ester-forming derivatives can be used singly or as a mixture of two or more thereof.

Preference is given to using succinic acid, adipic acid, azelaic acid, sebacic acid, brassylic acid or their respective ester-forming derivatives or mixtures thereof. Particular preference is given to using succinic acid, adipic acid, sebacic acid or their respective ester-forming derivatives or mixtures thereof. Succinic acid, azelaic acid, sebacic acid and brassylic acid also have the advantage of being obtainable from renewable raw materials.

Preference is given to the following aliphatic-aromatic polyesters: poly(butylene azealate-co-butylene terephthalate) (PBAzeT), poly(butylene brassylate-co-butylene terephthalate) (PBBrasT) and particularly preferably: poly (butylene adipate terephthalate) (PBAT), poly(butylene sebacate terephthalate) (PBSeT) or poly(butylene succinate terephthalate) (PEST).

Aromatic dicarboxylic acids or their ester-forming derivatives (a2) can be used singly or as mixture of two or more thereof. Particular preference is given to using terephthalic acid or its ester-forming derivatives such as dimethyl terephthalate.

In general, the diols (B) are selected from branched or linear alkanediols having 2 to 12 carbon atoms, preferably 4 to 6 carbon atoms, or cycloalkanediols having 5 to 10 carbon atoms.

Examples of suitable alkanediols are ethylene glycol, 1,2-propanediol, 1,3-propanediol, 1,2-butanediol, 1,4-butanediol, 1,5-pentanediol, 2,4-dimethyl-2-ethylhexane-1,3-diol, 2,2-dimethyl-1,3-propanediol, 2-ethyl-2-butyl-1,3-propanediol, 2-ethyl-2-isobutyl-1,3-propanediol, 2,2,4-trimethyl-1,6-hexanediol, especially ethylene glycol, 1,3-propanediol, 1,4-butanediol and 2,2-dimethyl-1,3-propanediol (neopentylglycol); cyclopentanediol, 1,4-cyclohexanediol, 1,2-cyclohexanedimethanol, 1,3-cyclohexanedimethanol, 1,4-cyclohexanedimethanol or 2,2,4,4-tetramethyl-1,3-cyclobutanediol. Particular preference is given to 1,4-butanediol, especially combined with adipic acid as component a1), and 1,3-propanediol, especially combined with sebacic acid as component a1). 1,3-Propanediol also has the advantage of being available as a renewable raw material. Mixtures of different alkanediols can also be used.

Preferably partly aromatic polyesters are characterized by a molecular weight (Mn) in the range from 1000 to 100000, especially in the range from 9000 to 75000 g/mol, preferably in the range from 10000 to 50000 g/mol and a melting point in the range from 60 to 170° C. and preferably in the range from 80 to 150° C.

By polyesters formed from aliphatic dicarboxylic acids and aliphatic diols are meant polyesters formed from aliphatic diols and aliphatic dicarboxylic acids such as polybutylene succinate (PBS), polybutylene adipate (PBA), polybutylene succinate adipate (PBSA), polybutylene succinate sebacate (PBSSe), polybutylene sebacate (PBSe). Aliphatic polyesters are marketed for example by Showa Highpolymers under the name of Bionolle and by Mitsubishi under the name of GSPIa. More recent developments are described in WO2010/034711, Biodegradable polyesters, in addition to or in place of the aforementioned aliphatic and aliphatic/aromatic polyesters, may comprise further polyesters such as, for example, polylactic acid, polybutylene succinates, poly(butylene succinate-co-adipate)s, polyhydroxyalkanoates, polyester amides, polyalkylene carbonate, polycaprolactone. Especially polylactic acid and polycaprolactone and polyhydroxyalkanoates must be mentioned as polyesters based on aliphatic hydroxy carboxylic acids. Preferred components in the polymer mixtures or else as straight components are polylactic acid (PLA), polybutylene succinates, poly(butylene succinate-co-adipate)s and polyhydroxyalkanoates, and of these especially polyhydroxybutyrate (PHB) and poly(hydroxybutyrate co-hydroxyvalerate) (PHBV) and poly(hydroxybutyrate-co-hydroxyhexanoate)s (PHBH).

Polylactic acid having the following profile of properties is used with preference:

a melt volume rate (MVR at 190° C. and 2.16 kg to ISO 1133) of 0.5-preferably 2-to 30, especially 9 ml/10 minutes a melting point below 240° C.;

a glass transition point (Tg) above 55° C.

a water content of below 1000 ppm a residual monomer content (lactide) of below 0.3%.

a molecular weight of above 80000 daltons.

Preferred polylactic acids are for example NatureWorks® 6201 D, 6202 D, 6251 D, 3051 D and especially 3251 D, 4032 D, 4043 D or 4044 D (polylactic acid from NatureWorks).

Polyhydroxyalkanoates are primarily poly-4-hydroxybutyrates and poly-3-hydroxybutyrates, but further comprise copolyesters of the aforementioned hydroxybutyrates with 3-hydroxyvalerates (P(3HB)-co-P(3HV)) or 3-hydroxyhexanoate. Poly-3-hydroxybutyrate-co-4-hydroxybutyrates (P(3HB)-co-P(4HB)) are known from Metabolix in particular. They are marketed under the trade name of Mirel®. Poly-3-hydroxybutyrate-co-3-hydroxyhexanoates (P(3HB)-co-P(3HH)) are known from P&G or Kaneka. Poly-3-hydroxybutyrates are marketed for example by PHB Industrial under the trade name of Biocycle® and by Tianan under the name of Enmat®.

The molecular weight $M_w$ of the polyhydroxyalkanoates is generally in the range from 100000 to 1000000 and preferably in the range from 300000 to 600000.

Polycaprolactone is marketed, for example, by Daicel under the product name of Placcel®.

Preferable polyester mixtures of partly aromatic polyesters and polylactic acid or polyhydroxyalkanoates are described in EP 1656 423, EP 1838784, WO 2005/063886, WO 2006/057353, WO 2006/057354, WO 2010/034710 and WO 2010/034712.

Polyalkylene carbonates primarily comprise polyethylene carbonate (see EP-A 1264860), obtainable by copolymerization of ethylene oxide and carbon dioxide and especially polypropylene carbonate (see for example WO 2007/125039) obtainable by copolymerization of propylene oxide and carbon dioxide.

The polyalkylene carbonate chain may comprise ether groups as well as carbonate groups. The proportion of carbonate groups in the polymer depends on the reaction conditions such as particularly the catalyst used. In preferable polyalkylene carbonates more than 85 and preferably more than 90% of all linkages are carbonate groups. Suitable zinc and cobalt catalysts are described in U.S. Pat. No. 4,789,727 and U.S. Pat. No. 7,304,172. Polypropylene carbonate is further obtainable similarly to Soga et al., Polymer Journal, 1981, 13, 407-10. The polymer is also commercially available, for example from Empower Materials Inc. or Aldrich.

At workup of polyalkylene carbonates, it is particularly important that the catalyst be removed as quantitatively as possible. For this, the general practice is to dilute the reaction mixture with a polar aprotic solvent such as, for example, a carboxylic ester (especially ethyl acetate), a ketone (especially acetone), an ether (especially tetrahydrofuran) to 2 to 10 times the volume. Subsequently, the reaction mixture is admixed with an acid such as acetic acid and/or an acid anhydride such as acetic anhydride and stirred for several hours at slightly elevated temperature. The organic phase is washed and separated. The solvent is preferably distilled off under reduced pressure and the residue dried.

The molecular weight Mn of polypropylene carbonates obtained by the abovementioned processes is generally in the range from 70000 to 90000 Da. The molecular weight Mw is typically in the range from 250000 to 400000 Da. The ratio of ether to carbonate groups in the polymer is in the range from 5:100 to 90:100. For improved performance characteristics, it can be advantageous to treat the polyalkylene carbonates with MA, acetic anhydride, di- or polyisocyanates, di- or polyoxazolines or -oxazines or di- or polyepoxides. Polypropylene carbonates having a molecular weight Mn of 30000 to 5000000, preferably 35000 to 250000 and more preferably 40000 to 150000 Da are obtainable in this way. Polypropylene carbonates having an Mn of below 25000 Da have a low glass transition temperature of below 25° C. Therefore, they have but limited usefulness for surface applications (e.g., coating) with the pigments mentioned. Polydispersity (ratio of weight average (Mw) to number average (Mn)) is generally between 1 and 80 and preferably between 2 and 10. The polypropylene carbonates used may comprise up to 1% of carbamate and urea groups.

Useful chain extenders for polycarbonates are especially MA, acetic anhydride, di- or polyisocyanates, di- or polyoxazolines or -oxazines or di- or polyepoxides. Examples of isocyanates are tolylene 2,4-diisocyanate, tolylene 2,6-diisocyanate, 2,2'-diphenylmethane diisocyanate, 2,4'-diphenylmethane diisocyanate, 4,4'-diphenylmethane diisocyanate, naphthylene 1,5-diisocyanate or xylylene diisocyanate and especially 1,6-hexamethylene diisocyanate, isophorone diisocyanate or methylenebis(4-isocyanatocyclohexane). Isophorone diisocyanate and especially 1,6-hexamethylene diisocyanate are particularly preferable aliphatic diisocyanates. As bisoxazolines there may be mentioned 2,2'-bis(2-oxazoline), bis(2-oxazolinyl)-methane, 1,2-bis(2-oxazolinyl)ethane, 1,3-bis(2-oxazolinyl)propane or 1,4-bis(2-oxazolinyl)-butane, especially 1,4-bis(2-oxazolinyl) benzene, 1,2-bis(2-oxazolinyl)benzene or 1,3-bis-(2-oxazolinyl)benzene. The amounts in which chain extenders are used are preferably in the range from 0.01% to 5%, more preferably in the range from 0.05% to 2% and even more preferably in the range from 0.08% to 1% by weight, based on the polymer quantity.

The biodegradable polyester polymer and/or polyalkylene carbonate polymer may further comprise additives. Possible additives include those typical in plastics technology: nucleating agents such as, for example, polybutylene terephthalate (PBT) in the case of copolyesters of PBT (e.g., PBAT, PBSeT, PBST), polybutylene succinate in the case of polylactic acid; slip and release agents such as stearates (especially zinc stearate, tin stearate and calcium stearate); plasticizers such as, for example, citric esters (especially tributyl citrate and tributyl acetylcitrate), glyceric esters such as triacetyl glycerol or ethylene glycol derivatives; surfactants such as polysorbates, palmitates or laurates; waxes such as, for example, carnauba wax, candelilla wax, beeswax or beeswax ester, jojoba oil, japan wax, spermaceti, lanolin; UV absorber (e.g., hydroquinones); UV stabilizers; antifog agents (e.g., polysorbates) or dyes. Additives are used in concentrations of 0% to 5% by weight and especially 0.1% to 2% by weight based on the biodegradable polyester polymer and/or polyalkylene carbonate polymer. Plasticizers may be present in 0.1% to 30% by weight (preferably: 0.1% to 10% by weight) based on the biodegradable polyester polymer and/or polyalkylene carbonate polymer.

Useful inorganic pigments include any pigments based on metal oxides, silicates and/or carbonates which is typically useful in the paper industry, especially pigments from the group consisting of calcium carbonate, which can be used in the form of ground calcium carbonate (GCC), lime, chalk, marble or precipitated calcium carbonate (PCC), talc, kaolin, bentonite, satin white, calcium sulfate, barium sulfate and titanium dioxide. It is also possible to use mixtures of two or more pigments.

The present invention utilizes inorganic pigments having an average particle size (Z-average) ≤10 μm, preferably in the range from 0.1 to 5 μm and especially in the range of to 0.1 to 4 μm.

The average particle size (Z-average) of the inorganic pigments as well as of the particles of the powder composition is generally effected herein by the method of quasi-elastic light scattering (DIN-ISO 13320-1) using for example a Mastersizer 2000 from Malvern instruments Ltd.

According to the present invention, biodegradable polyester polymers and/or polyalkylene carbonate polymers are arranged on the surface of inorganic pigments. Depending on the amount of polymer, the polymer arrangement on the surface takes the form of points, spots or dots, or takes the form of regions which can extend to where the polymer forms a uniform arrangement which resembles a layer, sheath, shell or envelope. The particles may be not only individual particles but also conjoined individual particles so-called agglomerates presumably conjoined by the biodegradable polymer.

In general, the fraction of biodegradable polymer is in the range from 0.1% to 100% by weight based on the inorganic pigment. The polymer fraction is preferably in the range from 0.25% to 7% by weight and especially 0.5% to 5% by weight based on the weight of inorganic pigments.

The powder composition of the present invention is produced by applying the biodegradable polyester polymer and/or polyalkylene carbonate polymer to the surface of the inorganic pigment.

This is preferably accomplished by treating the inorganic pigment with a solution of the biodegradable polyester polymer and/or polyalkylene carbonate polymer and subsequently removing the solvent.

By solvents for the biodegradable polyester polymer and/or polyalkylene carbonate polymer are meant diluents capable of dissolving at least 1 g of polymer per 100 g of solvent. Preferable solvents for polyester polymers are: chlorinated hydrocarbons, hexafluoroisopropanol at room temperature (23° C.) and a mixture of toluene and tetrahydrofuran at about 60° C.

Polyester amides and polyalkylene carbonates are soluble, depending on their composition, in toluene or tetrahydrofuran, or in ethanol or isopropanol, or in alkyl acetates such as ethyl acetate or in halogenated hydrocarbons.

The amount of biodegradable polymer used is generally in the range from 0.5% to 10% by weight and preferably in the range from 1% to 5% by weight based on the pigment content (filler content).

The powder composition of the present invention is preferably obtained by a) treating inorganic pigment with a solution of a polyester polymer and/or polyalkylene carbonate polymer and, b) spray-drying the mixture obtained by a).

It is further possible to coat the inorganic pigment as a solid, and in a spray coater, with a solution of the biodegradable polyester polymer and/or polyalkylene carbonate polymer.

The mixture (pigment dispersion) obtained by a) is preferably sprayed through single-material nozzles into a stream of hot air. The droplet size at the point of exit is chosen so as to produce a pigment powder wherein the pulverulent particles have an average particle size (Z-average) in the range from 1 to 200 μm. Nozzle diameter and admission pressure of the stream of material are chosen by a person skilled in the art as a function of the viscosity of the pigment suspension obtained by a). The higher the admission pressure, the smaller the droplets produced. Typically, the pigment dispersion obtained by a) is fed in the region of about 3 bar. It is advantageous to use a single-material nozzle equipped with a twist generator. Droplet size and spray angle can additionally be influenced via the choice of twist generator.

It is preferable to choose to spray a pigment dispersion (mixture) obtained by a) and comprising from 0.1% to 10% by weight and preferably from 0.5% to 5% by weight of polyester polymer and/or polyalkylene carbonate polymer based on the inorganic pigment.

The solids concentration of the pigment dispersion obtained by a) is advantageously 10-40% by weight. The solids concentration which is preferably used is 25-35% by weight.

The general procedure adopted is such that the inlet temperature of the hot air stream is in the range from 100 to 200° C. and preferably in the range from 120 to 180° C. and the outlet temperature of the hot air stream is in the range from 30 to 110° C. and preferably in the range from 50 to 90° C. The temperature difference between inlet and outlet temperatures is preferably at least 25° C. and more preferably at least 30° C. Fines are normally separated from the gas stream by means of cyclones or filter separators. The fines are preferably redispersed and recycled into the stream of material. The spray-dispensed pigment dispersion obtained by a) and the stream of hot air are preferably routed in parallel.

Furthermore, powder properties can also be influenced by the aftertreatment temperature at which the powder is discharged from the spray tower. The temperature range is typically set to 20-30° C., rarely higher than 40° C.

Optionally, spraying assistants are added at the spray-drying stage to facilitate the spray-drying operation or achieve certain pulverulent properties, for example low dust, flowability or improved redispersibility. A person skilled in the art will be familiar with a multiplicity of spraying assistants. Examples of spraying assistants are found in DE-A 19629525, DE-A 19629526, DE-A 2214410, DE-A 2445813, EP-A 407889 or EP-A 784449. Advantageous spraying assistants are for example water-soluble polymers of the polyvinyl alcohol type or partially hydrolyzed polyvinyl acetates, cellulose derivatives such as hydroxyethylcellulose, carboxymethylcellulose, methylcellulose, methylhydroxyethylcellulose and methylhydroxypropylcellulose, polyvinylpyrrolidone, copolymers of vinylpyrrolidone, gelatin, preferably polyvinyl alcohol and partially hydrolyzed polyvinyl acetates and methylhydroxypropylcellulose.

The powder compositions obtained by spray drying have a particle size of 0.3 to 300 μm, preferably of 0.3 to 30 μm and especially of 0.3 to 10 μm.

The powder compositions of the present invention are very useful as fillers for production of paper, card and board. Therefore, the present application also relates to the use of the powder composition of the present invention as a filler in the production of filled papers, card and board.

The present application further relates to a process for production of filled paper, card and board by adding the powder composition of the present invention to a paper stock and then draining the paper stock with sheet formation and drying.

Preferably, the powder composition of the present invention is used in the form of an aqueous suspension obtainable by suspending the powder composition of the present invention in water. The aqueous suspension of the powder composition is obtainable by the following process steps:

a) treating inorganic pigment with a solution of a polyester polymer and/or polyalkylene carbonate polymer, b) spray-drying the mixture obtained by a), and c) dispersing in water the powder composition obtained by b).

The aqueous suspensions of the powder compositions of the present invention preferably comprise from 1% to 60% by weight and preferably from 10% to 50% by weight of the powder composition of the present invention.

The powder compositions of the present invention are processed into an aqueous suspension by being introduced into water for example. To produce aqueous suspensions of powder compositions according to the present invention an anionic dispersant can be used, for example a polyacrylic acid having an average molar mass $M_w$ of for example 1000 to 40000 daltons. When an anionic dispersant is used, the amount in which it is used to produce aqueous suspensions is for example in the range from 0.01% to 0.5% by weight and preferably in the range from 0.2% to 0.3% by weight. The powder compositions according to the present invention which are dispersed in water in the presence of anionic dispersants are anionic.

The aqueous suspensions of the powder composition of the present invention can be used for producing any filled styles of paper, for example newsprint, supercalendered (SC) paper, wood-free or wood-containing writing and printing papers. Such papers are produced using as main raw material components for example groundwood, thermomechanical pulp (TMP), chemothermomechanical pulp (CTMP), pressure groundwood (PGW) and also sulfite and sulfate pulp. Using aqueous suspensions of the powder composition according to the present invention makes it possible to achieve a distinct increase in the filler content of paper coupled with virtually unchanged strength properties. Papers of this kind have strength properties that are comparable to those of conventional papers having a low solids content.

The aqueous suspensions of the powder compositions of the present invention are admixed to the fiber in paper production in order that the total paper stock may be formed in this way. In addition to the treated fillers and fibers, the total stock may additionally comprise other conventional paper additives. Conventional paper additives are for example sizing agents, wet strength agents, cationic or anionic retention aids based on synthetic polymers, and also dual systems, drainage aids, other dry strength enhancers, pigments not coated according to the present invention, fillers, optical brighteners, defoamers, biocides and paper dyes. These conventional paper additives can be used in the customary amounts.

Useful sizing agents include alkylketene dimers (AKDs), alkenylsuccinic anhydrides (ASAs) and resin size.

Useful retention aids include for example anionic microparticles (colloidal silica, bentonite), anionic polyacrylamides, cationic polyacrylamides, cationic starch, cationic polyethyleneimine or cationic polyvinylamine. Any combinations thereof are also conceivable, for example dual systems consisting of a cationic polymer with an anionic microparticle or an anionic polymer with a cationic microparticle. To achieve high retention of filler, it is advisable to add such retention aids, which can be added for example to the thick stuff but also to the thin stuff.

Dry strength enhancers are synthetic dry strength enhancers such as polyvinylamine or natural dry strength enhancers such as starch.

The powder composition of the present invention makes it possible to produce paper having a high filler content. The powder compositions used according to the present invention in a process for production of paper and paper-based products allow the manufacture of paper of higher filler content. The strength loss which is generally occasioned by the higher filler content is distinctly smaller compared with known processes of the prior art. The powder compositions of the present invention, on inclusion as a filler in paper and paper-based products, lead to good strengths. This provides good printability (improved linting and dusting) combined with unchanged or improved paper machine efficiency.

The invention further relates to the use of the powder composition of the present invention as a filler in the surface coating of papers and paper-based products. The powder composition of the present invention is preferably used in the form of an aqueous suspension.

The invention further also provides a paper coating composition comprising (i) a powder composition according to the present invention, and (ii) an aqueous binder dispersion, and optionally further added substances.

Paper coating compositions, in addition to water, generally comprise pigments, binders and auxiliaries to set the required rheological properties, for example thickeners. The pigments are typically in a dispersed state in water. The paper coating composition comprises pigments in an amount of preferably at least 80% by weight, for example 80% to 95% by weight or 80% to 90% by weight, based on the total solids content. The powder composition of the present invention can be used exclusively as pigment. It is also possible, however, to replace some of the total pigment quantity by conventional pigment. The proportion accounted for by the powder composition of the present invention should be at least 30% by weight based on the total pigment quantity.

White pigments in particular are contemplated as conventional pigment. Suitable pigments are for example metal salt pigments such as, for example, calcium sulfate, calcium aluminate sulfate, barium sulfate, magnesium carbonate and calcium carbonate, of which carbonate pigments and especially calcium carbonate are preferred. The calcium carbonate can be natural ground calcium carbonate (GCC), precipitated calcium carbonate (PCC), lime or chalk. Suitable calcium carbonate pigments are available for example as Covercarb® 60, Hydrocarb® 60 or Hydrocarb® 90 ME. Further suitable pigments are for example silicas, aluminas, aluminum hydrate, silicates, titanium dioxide, zinc oxide, kaolin, argillaceous earth, talc or silicon dioxide. Suitable further pigments are available for example as Capim® MP 50 (clay), Hydragloss® 90 (clay) or Talcum C10.

The paper coating composition comprises at least one binder. The most important functions of binders in paper coating compositions are to bind the pigments to the paper and the pigments to each other and to some extent fill voids between particles of pigment. For every 100 parts by weight of pigments (total pigment/invention pigment), the amount of organic binder used (in terms of binder solids, i.e., without water or other solvents which are liquid at 21° C., 1 bar) is for example in the range from 1 to 50 parts by weight, preferably in the range from 1 to 25 parts by weight or in the range from 5 to 20 parts by weight.

Suitable binders are, first, natural-based binders, especially starch-based binders, and also synthetic binders, especially emulsion polymers obtainable by emulsion polymerization. Starch-based binders in this context are to be understood as meaning any native, modified or degraded starch. Native starches can consist of amylose, amylopectin or mixtures thereof. Modified starches can be oxidized starch, starch esters or starch ethers. Hydrolysis can be used to reduce the molecular weight of starch (to obtain degraded starch). Useful degradation products include oligosaccharides or dextrins. Preferred starches are cereal starch, maize starch and potato starch. Particular preference is given to cereal starch and maize starch and very particular preference is given to cereal starch.

Suitable synthetic binders are polymers obtainable by free-radical polymerization of ethylenically unsaturated compounds. Useful synthetic binders include for example polymers constructed to an extent of at least 40% by weight of so-called main monomers selected from $C_1$- to $C_{20}$-alkyl (meth)acrylates, vinyl esters of carboxylic acids comprising up to 20 carbon atoms, vinylaromatics having up to 20 carbon atoms, ethylenically unsaturated nitriles, vinyl halides, vinyl ethers of alcohols comprising from 1 to 10 carbon atoms, aliphatic hydrocarbons having 2 to 8 carbon atoms and one or two double bonds, or mixtures thereof.

Paper coating compositions of the present invention may additionally comprise further addition and auxiliary agents, for example fillers, cobinders and thickeners to further optimize viscosity and water retention, optical brighteners, dispersants, surfactants, slip agents (e.g., calcium stearate and waxes), neutralizing agents (e.g., NaOH or ammonium hydroxide) for pH adjustment, defoamers, deaerators, preservatives (e.g., biocides), flow control agents, dyes (especially soluble dyes), etc. Useful thickeners include not only synthetic chain growth addition polymers (e.g., crosslinked polyacrylate), especially celluloses, preferably carboxymethylcellulose. Optical brighteners are, for example, fluorescent or phosphorescent dyes, especially stilbenes.

The paper coating composition of the present invention preferably is an aqueous paper coating composition; water is present therein particularly due to the make-up form of the constituents (aqueous polymer dispersions, aqueous pigment slurries); the desired viscosity can be set by adding further water. Customary solids contents for the paper coating compositions range from 30% to 70% by weight. The pH of the paper coating composition is preferably adjusted to values in the range from 6 to 10 and especially in the range from 7 to 9.5.

The invention also provides paper or board coated with a paper coating composition of the present invention and a process for coating paper or board wherein

- a powder composition according to the present invention is produced or provided; and
- this powder composition, at least one binder dispersion and optionally further auxiliaries are used to produce a paper coating composition; and the paper coating composition is applied to at least one surface of paper or board.

The paper coating composition is preferably applied to uncoated base papers or uncoated board. The amount is generally in the range from 1 to 50 g and preferably in the range from 5 to 30 g (in terms of solids, i.e., without water or other solvent liquid at 21° C., 1 bar) per square meter. Coating can be effected by means of customary methods of application, for example via size press, film press, blade coater, air brush, doctor blade, curtain coating or spray coater. Depending on the pigment system, the aqueous dispersions of water-soluble copolymers can be used in paper coating compositions for the basecoat and/or for the topcoat.

The paper coating compositions of the present invention have good performance characteristics. More particularly, they are effective in improving paper strength.

The examples which follow are nonlimiting and illustrate the invention.

EXAMPLES

1.) Analytical Method

Molecular weights $M_n$ and $M_w$ of partly aromatic polyesters were determined as follows:

15 mg of partly aromatic polyester were dissolved in 10 ml of hexafluoroisopropanol (HFIP). 125 μl at a time of this solution were analyzed using gel permeation chromatography (GPC). The measurements were carried out at room temperature. HFIP+0.05% by weight of potassium trifluoroacetate salt was used for elution. The elution rate was 0.5 ml/min. Column combination used was as follows (all columns from Showa Denko Ltd., Japan): Shodex® HFIP-800P (diameter 8 mm, length 5 cm), Shodex® HFIP-803 (diameter 8 mm, length 30 cm), Shodex® HFIP-803 (diameter 8 mm, length 30 cm). The partly aromatic polyesters were detected using an RI detector (differential refractometry). Narrowly distributed polymethyl methacrylate standards having molecular weights of $M_n$=505 to $M_n$=2 740 000 were used for calibration. Elution ranges outside this interval were determined by extrapolation.

Viscosity numbers were determined in accordance with DIN 53728 Part 3, Jan. 3, 1985, Capillary viscosity. An M-II type Micro-Ubbelohde was used. The solvent used was the 50/50 w/w phenol/dichlorobenzene mixture.

Melt volume-flow rate (MVR) was determined in line with EN ISO 1133. Test conditions were 190° C., 2.16 kg. Melting time was 4 minutes. MVR gives the rate of extrusion of a molten plastics molding through an extrusion die of defined length and defined diameter under prescribed conditions: temperature, loading and attitude of the piston. What is determined is the volume in the cylinder of an extrusion plastometer that is extruded within a defined period.

2.) Producing the Inventive Powder Composition

Biodegradable polymers used:

Ecoflex F Blend C 1300 polybutylene adipate-terephthalate (PBAT), MVR (190° C., 2.16 kg) to EN ISO 1133 of 10.0 ml/10 min.

Ecovio FS Paper C1500, compound comprising polybutylene sebacate-terephthalate (PBSeT), and polylactic acid (PLA) with MVR (190° C., 2.16 kg) to EN ISO 1133 of 20 ml/10 min. Polypropylene carbonate (PPC) with average molecular weight Mn 52000 g/mol and a molecular weight Mw of 910000 g/mol, determined using gel permeation chromatography. Cationic polyamide (Percol 540, retention aid based on polyacrylamide, from BASF SE).

Hydrocarb OG calcium carbonate from Omya with D50 of 2.1 μm, D98 <10 μm was also used.

Example 1

Spray-Drying a Suspension of Calcium Carbonate with Polypropylene Carbonate To produce the suspension, 3 parts by weight of polypropylene carbonate were dissolved in 70 parts by weight of ethanol at room temperature (23° C.). Then, 27 parts by weight of calcium carbonate (Hydrocarb OG) were added to the solution, which was homogenized for 5 minutes in an ultrasonic bath.

The suspension thus obtained was fed with a peristaltic pump into the spray tower. The suspension to be dried was atomized with nitrogen gas (4 $m^3$/h, 3 bar) in a two-material nozzle 1.2 mm in diameter. Heated nitrogen gas at 80° C. was introduced in parallel to dry the dispersed particles of the suspension to form solid particles of about 5 to 20 μm. The drying gas was fed tangentially in the inlet region of the spray dryer. The dry particles of product were separated off in a cyclone, the off-gas being removed via the exhaust mains. The cyclone was heated to about 53° C.

Example 2

Calcium Carbonate with Ecovio FS Paper

Three parts by weight of Ecovio FS Paper C1500 and 70 parts by weight of dichloromethane were made into a solution at room temperature (23° C.). Then, 27 parts by weight of calcium carbonate (Hydrocarb OG) were added followed by homogenization in an ultrasonic bath for 5 minutes. This was followed by spray drying similarly to Example 1.

Example 3

Calcium Carbonate with Ecoflex F Blend C1300

1.5 parts by weight of Ecoflex F-Blend C1300 were dissolved in 85 parts by weight of dichloromethane at room temperature (23° C.). Then, 13.5 parts by weight of calcium carbonate (Hydrocarb OG) were added followed by homogenization in an ultrasonic bath for 5 minutes. This was followed by spray drying similarly to Example 1.

Producing the aqueous dispersions of inventive powder compositions.

Examples D1-D3

Dispersion D1

40 g of the powder composition obtained according to Example 1 were initially charged to a glass beaker and subsequently diluted with 60 g of tap water. During the addition and thereafter, the mixture was stirred with a Heiltof stirrer at 1000 revolutions per minute (rpm). The pH of the mixture was subsequently adjusted to 8.5.

Dispersions D2 and D3

In a manner similar to the production of dispersion D1, 20% by weight aqueous dispersions were likewise produced of the powder compositions of Examples 2 and 3.

Use Examples

Production of Filled Paper

Producing the Paper Stock Suspension (Pulp)

Bleached pulp (100% eucalyptus pulp) and tap water at a solids concentration of 4% were pulped in a laboratory pulper until free of fiber bundles and subsequently beaten to a freeness of 30-35 SR. The pH of the stuff was in the range between 7 and 8. The beaten stuff was subsequently diluted with tap water to a solids concentration of 0.5% (5 g/l paper stock concentration).

Example P1

Polypropylene Carbonate

The above paper stock suspension was admixed with the 20% by weight dispersion of Example D1 using 25 parts by weight of powder composition (solids) per 75 parts by weight of paper stock (solids). Thereafter, 0.01% by weight (solids) based on paper stock (solids) of a cationic polyacrylamide (Percol 540) was added. A sheet was formed therefrom with a grammage of 80 g/m$^2$ (filler content 25% by weight). The sheets of paper were each fabricated with a sheet weight of 80 g/m$^2$ on a Rapid-Köthen sheet-former to ISO 5269/2 and subsequently dried at 90° C. for 7 minutes and thereafter calendered using a nip pressure of 300 N/cm.

Example P2

Ecovio FS Paper

The above paper stock suspension was admixed with the 20% by weight dispersion of Example D2 using 20 parts by weight of powder composition (solids) per 80 parts by weight of paper stock (solids). Thereafter, 0.01% by weight (solids) based on paper stock (solids) of a cationic polyacrylamide (Percol 540) was added. A sheet was formed therefrom with a grammage of 80 g/m$^2$ (filler content 20% by weight). The sheets of paper were each fabricated with a sheet weight of 80 g/m$^2$ on a Rapid-Kothen sheet-former to ISO 5269/2 and subsequently dried at 90° C. for 7 minutes and thereafter calendered using a nip pressure of 300 N/cm.

Example P3

Ecoflex F Blend

The above paper stock suspension was admixed with the 20% by weight dispersion of Example D3 using 20 parts by weight of powder composition (solids) per 80 parts by weight of paper stock (solids). Thereafter, 0.01% by weight (solids) based on paper stock (solids) of a cationic polyacrylamide (Percol 540) was added. A sheet was formed therefrom with a grammage of 80 g/m$^2$ (filler content 20% by weight). The sheets of paper were each fabricated on a Rapid-Kothen sheet-former to ISO 5269/2 and subsequently dried at 90° C. for 7 minutes and thereafter calendered using a nip pressure of 300 N/cm.

Example P4

Not Inventive

Similarly to Example P1, the above paper stock suspension was admixed with the 20% by weight calcium carbonate dispersion (Hydrocarb OG) using 25 parts by weight of powder composition (solids) per 75 parts by weight of paper stock (solids). Thereafter, 0.01% by weight (solids) based on paper stock (solids) of a cationic polyacrylamide (Percol 540) was added. In a repeat of Example 1, a sheet of paper having a sheet weight of 80 g/m$^2$ was fabricated, subsequently dried at 90° C. for 7 minutes and thereafter calendered using a nip pressure of 300 N/cm.

Example P5

Not Inventive

Example P4 was repeated except that 20 parts by weight of calcium carbonate (solids) in the form of a 20% by weight dispersion were used per 80 parts by weight of paper stock (solids)

Testing the Sheets of Paper

Following 12 hours of storage time in a conditioning chamber at a constant 23° C. and 50% relative humidity, the dry breaking length of the sheets was determined to DIN 54540 and the inner strength (Z-strength N) to Zwick (Tappi T541 om-89). Dry pick strength was determined using the IGT printability tester (ISO 3783). The results are reported in Table 1.

TABLE 1

Results of performance testing of paper sheets

| Example | Polymer | Dry breaking length (m) | Z-strength N | IGT |
|---|---|---|---|---|
| P1 | PPC | | 225 | very good |
| P4 (n.i.) | — | | 165 | good |
| P2 | Ecovio FS Paper | 4450 | 440 | very good |

TABLE 1-continued

Results of performance testing of paper sheets

| Example | Polymer | Dry breaking length (m) | Z-strength N | IGT |
|---|---|---|---|---|
| P5 (n.i.) | — | 2760 | 320 | good |
| P3 | Ecoflex F Blend | 4380 | 400 | very good |

n.i.: not inventive

A comparison of untreated pigment (P4) with pigment with PPC (P1) shows a distinct improvement in strength. Z-Strength is up by 36%. The untreated pigment gave 165 N, the treated pigment 225 N.

A comparison of untreated pigment (P5) with pigment with Ecovio FS Paper (P2) shows significant increases in strength. Z-Strength is up by almost 36%, dry breaking length by 58%. Z-Strength rose from 320 N to 440 N, dry breaking length from 2760 to 4450 m.

A comparison of untreated pigment (P5) with pigment with Ecoflex F Blend (P3) shows significant increases in strength. Z-Strength is up by almost 24%, dry breaking length by 58%. Z-Strength rose from 320 N to 400 N, dry breaking length from 2760 to 4380 m.

This application claims priority from U.S. provisional application No. 61/495,385, incorporated herein by reference.

We claim:

1. A process for production of filled paper, card and board, comprising:

adding an aqueous suspension of a powder composition comprising at least one inorganic pigment, wherein at least one biodegradable polyester polymer and/or polyalkylene carbonate polymer is arranged on the surface of the inorganic pigment, to a paper stock and then draining the paper stock with sheet formation and drying.

2. The process according to claim 1, wherein the biodegradable polyester polymer and/or polyalkylene carbonate polymer is a water-insoluble biodegradable polyester polymer and/or polyalkylene carbonate polymer.

3. The process according to claim 1, wherein the biodegradable polyester polymer is a polyester based on aliphatic and aromatic dicarboxylic acids with aliphatic dihydroxy compounds or aliphatic dicarboxylic acids with aliphatic dihydroxy compounds or composed of aliphatic hydroxy carboxylic acids.

4. The process according to claim 1, wherein at least one aliphatic-aromatic polyester polymer is added to the paper stock.

5. The process according to claim 1, wherein a polypropylene carbonate is added to the paper stock.

6. The process according to claim 1, wherein the inorganic pigment is in the form of particles having an average particle size of 0.1 to 5 μm.

7. The process according to claim 1, wherein the powder composition comprises from 0.1% to 100% by weight of the biodegradable polyester polymer and/or polyalkylene carbonate polymer based on the inorganic pigment.

8. The process according to claim 1, further comprising:

applying the at least one polyester polymer and/or polyalkylene polycarbonate polymer to the surface of the at least one inorganic pigment.

9. The process according to claim 8 wherein at least one inorganic pigment is treated with a solution of a polyester polymer and/or polyalkylene carbonate polymer and subsequently the solvent is removed.

10. The process according to claim 8 wherein the treatment is carried out as a spray-drying operation.

11. The process for production of filler paper, card and board according to claim 1, wherein the aqueous suspension of the powder composition is obtained by treating the inorganic pigment with a solution of the polyester polymer and/or polyalkylene carbonate polymer, then removing the solvent and then dispersing the resulting powder composition in water.

12. The process according to claim 1, wherein the aqueous suspension of the powder composition is obtained by the following process steps:

a) treating the inorganic pigment with a solution of the polyester polymer and/or polyalkylene carbonate polymer, b) spray-drying the mixture obtained by a), and c) dispersing in water the powder composition obtained by b).

13. A process for producing at least one of a filled paper, card and board, comprising:

mixing an aqueous suspension of a powder composition comprising at least one inorganic pigment and a polyalkylene carbonate polymer with a paper stock to form a filled paper stock, draining the filled paper stock to form a wet sheet, and drying the wet sheet to form the filled paper, card and board, wherein the polyalkylene carbonate polymer is arranged on the surface of the inorganic pigment.

14. The process according to claim 13, further comprising:

surface coating at least one of the filled paper, card and board with the aqueous suspension of the powder composition.

* * * * *